US008661677B2

(12) United States Patent
Omi et al.

(10) Patent No.: US 8,661,677 B2
(45) Date of Patent: Mar. 4, 2014

(54) MANUFACTURING METHOD OF RACK SHAFT

(75) Inventors: Hiroyuki Omi, Yao (JP); Kazuo Ukai, Nara (JP)

(73) Assignee: JTEKT Corporation, Osaka-shi (JP)

( * ) Notice: Subject to any disclaimer, the term of this patent is extended or adjusted under 35 U.S.C. 154(b) by 1466 days.

(21) Appl. No.: 11/459,697

(22) Filed: Jul. 25, 2006

(65) Prior Publication Data

US 2007/0034036 A1 Feb. 15, 2007

(30) Foreign Application Priority Data

Jul. 26, 2005 (JP) ..... 2005-216128

(51) Int. Cl.
*B21D 53/28* (2006.01)

(52) U.S. Cl.
USPC ..... 29/893.34; 72/360

(58) Field of Classification Search
USPC ..... 29/893.34, 893.35, 893.33, 893.36, 29/893.3; 72/352, 360, 361, 370.21
See application file for complete search history.

(56) References Cited

U.S. PATENT DOCUMENTS

| | | | | |
|---|---|---|---|---|
| 4,646,554 | A * | 3/1987 | Wallis et al. | 72/406 |
| 2005/0072002 | A1* | 4/2005 | Kubota | 29/893.34 |
| 2005/0115298 | A1* | 6/2005 | Brenner | 72/370.21 |

FOREIGN PATENT DOCUMENTS

| | | | | |
|---|---|---|---|---|
| DE | 20 2004 004860 | U1 | 5/2004 | |
| GB | 2 113 589 | A | 8/1983 | |
| JP | A-58-128242 | | 7/1983 | |
| JP | 61242738 | A * | 10/1986 | B21K 1/30 |
| JP | 4-28582 | B2 | 5/1992 | |
| JP | 07-124676 | A | 5/1995 | |
| JP | A-8-047741 | | 2/1996 | |
| JP | A-9-175412 | | 7/1997 | |
| JP | 3044884 | B2 | 3/2000 | |
| WO | WO-03/064074 | A1 | 8/2003 | |

OTHER PUBLICATIONS

Takanobu Mori, Manufacturing Principle of Orbital Forging and Forging Equipment.

Japanese Patent Office, *Japanese Office Action for Japanese Patent Application 2005-216128* (with English translation), dated Jan. 11, 2011, pp. 1-2.

* cited by examiner

*Primary Examiner* — David Bryant
*Assistant Examiner* — Ryan J Walters
(74) *Attorney, Agent, or Firm* — Oliff PLC

(57) ABSTRACT

In a manufacturing method of a rack shaft, the rack shaft is formed by mounting a shaft raw material on a receiving groove of a lower mold, the receiving mold having an approximately U-shaped cross section, thereafter arranging an upper mold having a rack-teeth-forming teeth portion formed in a rectangular shape in a bottom view and capable of oscillating in a width direction of the receiving groove around a center in the width direction of the rack-teeth-forming teeth portion, in such a manner that the center of oscillation lies on a vertical line of a center in a width direction of the rack teeth, pressing the shaft raw material in the diametrical direction, deforming the shaft raw material along the receiving groove, and thereafter deforming the shaft raw material while oscillating the upper mold so as to form a rack teeth.

4 Claims, 4 Drawing Sheets

MANUFACTURING METHOD OF RACK SHAFT

CROSS-REFERENCE TO RELATED APPLICATIONS

This Nonprovisional application claims priority under 35 U.S.C. §119(a) on Patent Application No. 2005-216128 filed in Japan on Jul. 26, 2005, the entire contents of which are hereby incorporated by reference.

BACKGROUND OF THE INVENTION

1. Field of the Invention

The present invention relates to a manufacturing method of a rack shaft having a rack teeth in a part of a peripheral surface.

2. Description of Related Art

A rack shaft is manufactured by a rack cutting machine or a forging. The manufacturing method by the forging uses a lower mold having a receiving groove, and an upper mold having a punch at a position facing to the receiving groove, and forms a rack teeth by mounting a shaft raw material on the receiving groove, thereafter executing a die matching of the upper mold and the lower mold, linearly moving the punch having a plurality of rack-teeth-forming teeth portions, and pressing the shaft raw material in a diametrical direction (See, for example, Japanese Patent Application Laid Open No. H04-28582). Further, as the manufacturing method by the forging, there has been known a manufacturing method of using an upper mold having a plurality of rack-teeth-forming teeth portions without using the punch, and linearly descending the upper mold so as to form the rack teeth on the shaft raw material.

However, in the method of manufacturing the rack shaft by linearly descending the punch or the upper mold, since the pressing force of the punch or the upper mold is applied to the peripheral surface of the shaft raw material all at once, it is hard to compress the shaft raw material into an entire region of a bottom of the rack-teeth-forming teeth portion. Further, since the pressing force of the punch or the upper mold becomes strongest in a center portion of the rack-teeth-forming teeth portion, and the pressing force becomes weaker in accordance with being back away from the center portion, an amount of deformation in a diameter direction (a direction of a face width) is smaller in comparison with an amount of deformation in a direction of an axial length. Accordingly, in the method of manufacturing the rack shaft by linearly moving the punch or the upper mold, there is a problem that an underfill tends to be generated in an end of the rack teeth in the direction of the face width, and it is hard to form an accurate rack teeth.

BRIEF SUMMARY OF THE INVENTION

The present invention is made in view of the above mentioned circumstances, and a main object of the present invention is to provide a manufacturing method capable of manufacturing a rack shaft in which an underfill is hard to be generated in an end of a rack teeth in a face width direction, in accordance with a forging.

A manufacturing method of a rack shaft in accordance with a first aspect of the present invention comprises the steps of mounting a shaft raw material on a receiving groove of a lower mold and pressing a part of a peripheral surface of the shaft raw material with an upper mold having a rack-teeth-forming teeth portion formed in a rectangular shape in a bottom view, thereby forming rack teeth, the upper mold being capable of oscillating in a width direction of the receiving groove around an oscillation center which lies on the center in the width direction of the rack-teeth-forming teeth portion.

In a manufacturing method of a rack shaft in accordance with a second aspect of the present invention, one of the lower mold and the upper mold is allowed to move up and down, and a cross section of the receiving groove is formed approximately in a U shape, and further comprising the steps of pressing the shaft raw material mounted on the receiving groove by upward or downward movement of the one of the lower mold and the upper mold, and deforming the shaft raw material along the receiving groove and forming the rack teeth by the upper mold.

In a manufacturing method of a rack shaft in accordance with a third aspect of the present invention, the upper mold is arranged in such a manner that the oscillation center lies on a vertical line of the center in the width direction of the rack teeth being formed.

In accordance with the first aspect of the present invention, since the rack teeth is formed while oscillating the upper mold having the rack-teeth-forming teeth portion formed in the rectangular shape in the bottom view around the center in the width direction of the rack-teeth-forming teeth portion, it is possible to uniformly apply the pressing force to the position of the shaft raw material in the diametrical direction. Accordingly, the underfill is hard to be generated in the end of the rack teeth in the face width direction, and it is easy to form the accurate rack teeth.

In accordance with the second aspect of the present invention, since it is possible to control the displacement of the shaft raw material in the peripheral direction by the receiving groove having the approximately U-shaped cross section, and the upper mold is oscillated under this controlled state, it is possible to further easily form the accurate rack teeth.

In accordance with the third aspect of the present invention, since the pressing force is alternately applied to the positions having the equal distance in the diametrical direction from the center in the diametrical direction of the shaft raw material, it is possible to further uniformly apply the pressing force to the position of the shaft raw material in the diametrical direction, and it is possible to easily form the more accurate rack teeth.

The above and further objects and features of the invention will more fully be apparent from the following detailed description with accompanying drawings.

DETAILED DESCRIPTION OF THE INVENTION

Figure 1:
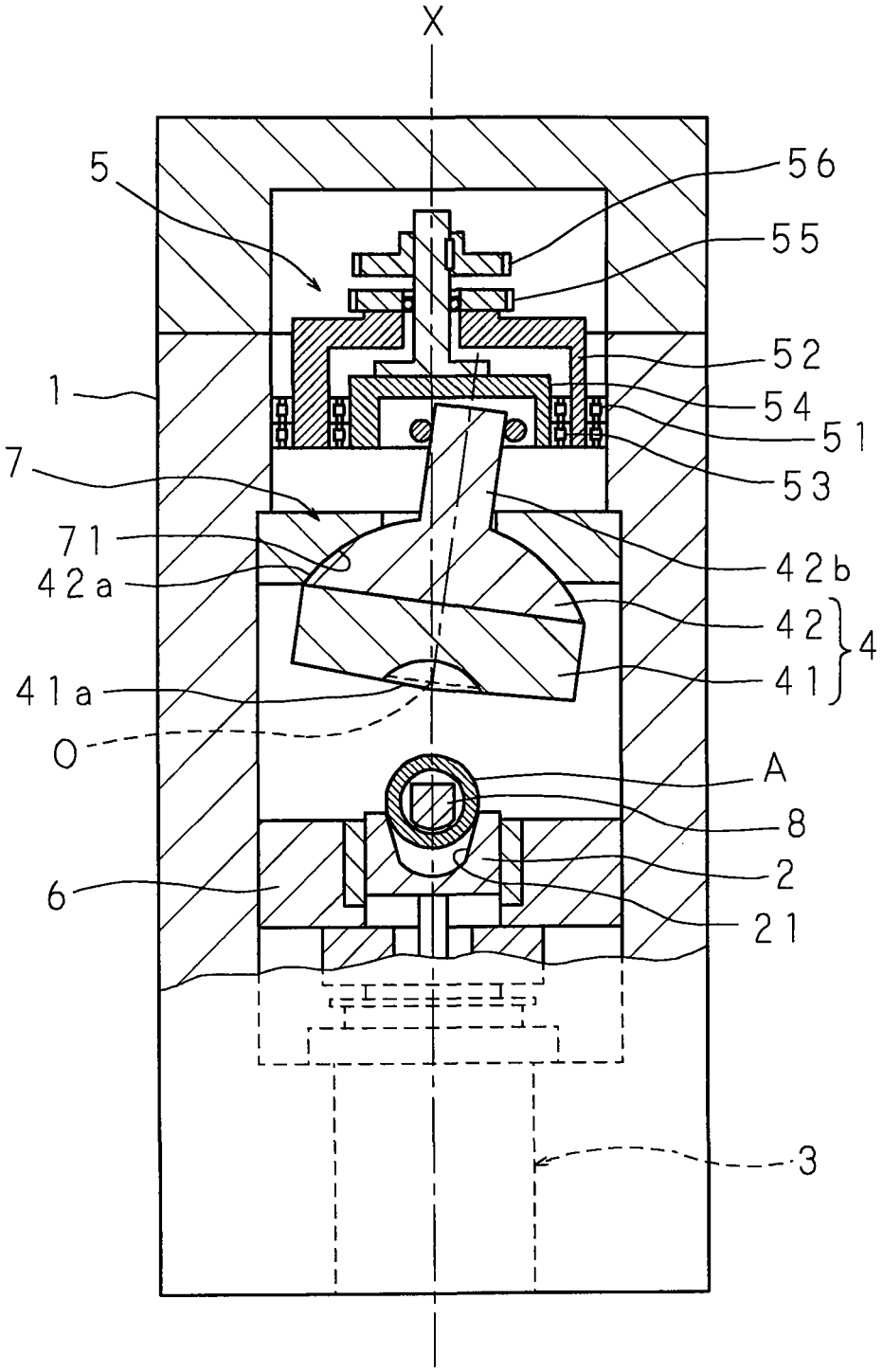
FIG. 1 is a schematic view showing a structure of a rocking die forging press machine.
Figure 2:
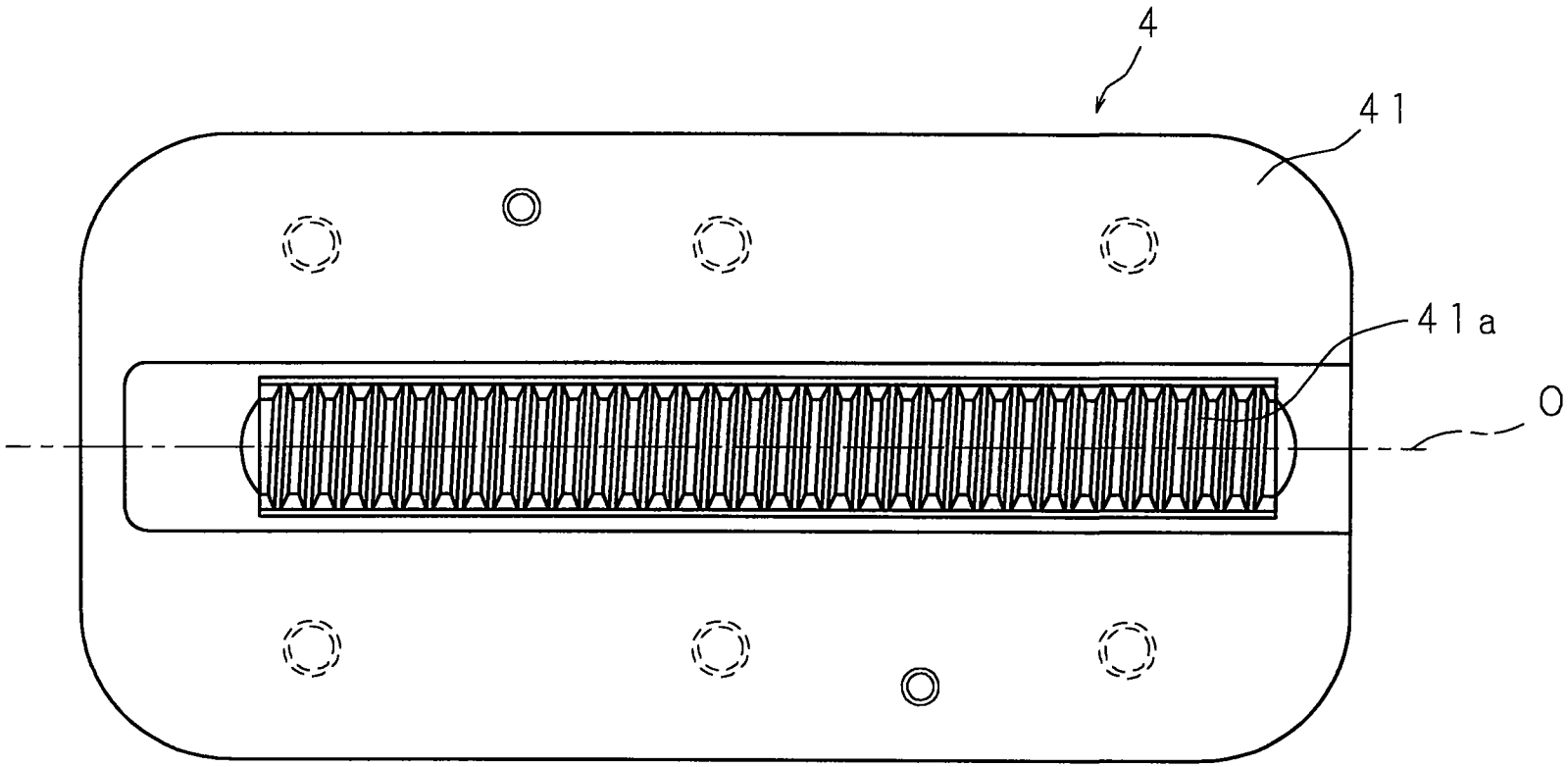
FIG. 2 is a bottom elevational view showing a structure of an upper mold.
Figure 3:
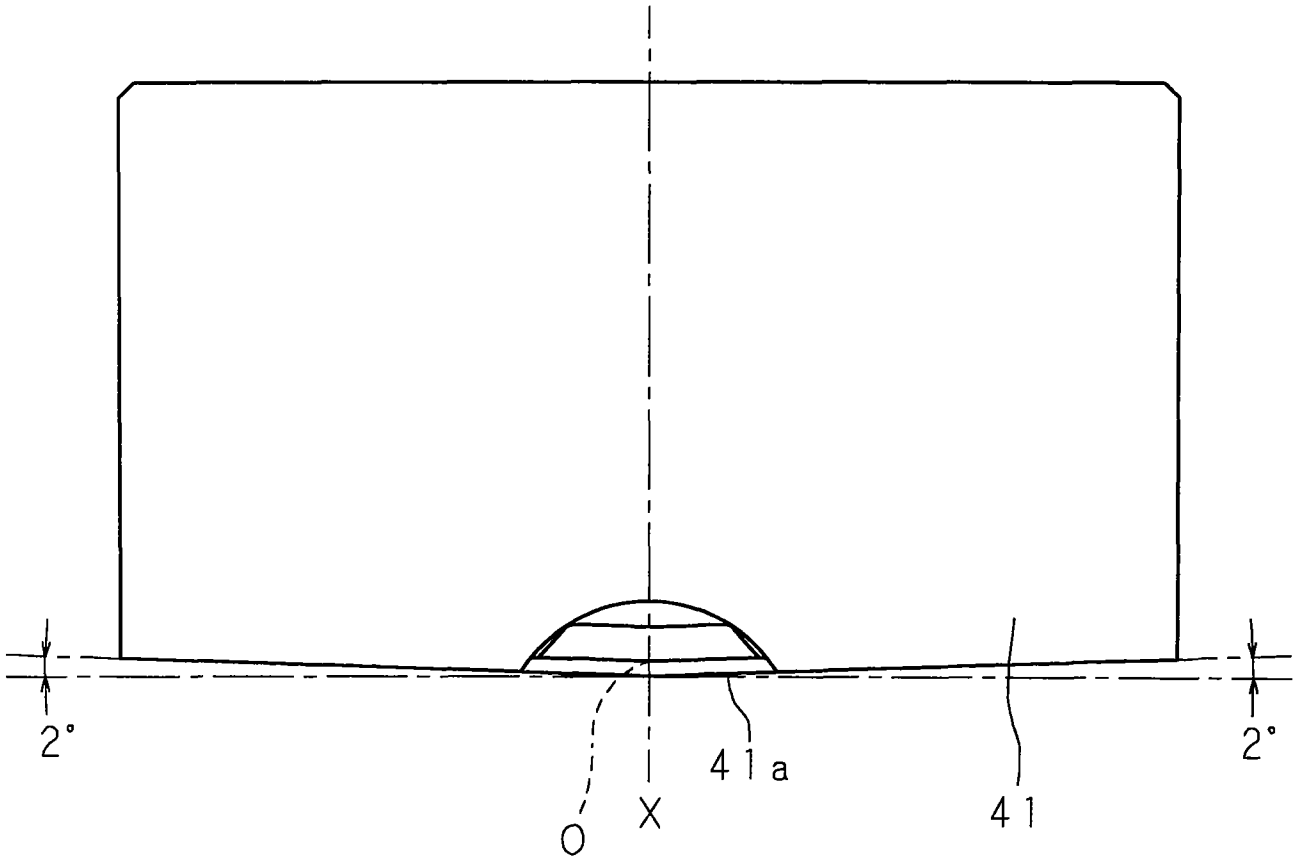
FIG. 3 is a side elevational view showing the structure of the upper mold.

A description will be in detail given below of the present invention with reference to the accompanying drawings showing an embodiment of the present invention. FIG. 1 is a schematic view showing a structure of a rocking die forging press machine, FIG. 2 is a bottom elevational view showing a structure of an upper mold, and FIG. 3 is a side elevational view showing the structure of the upper mold.

A metal round pipe is employed as a shaft raw material A for a rack shaft. A solid metal round rod may also be employed.

The shaft raw material A is forged by a rocking die forging press machine. The rocking die forging press machine is provided with a machine casing 1, a lower mold 2 arranged in a lower side of the machine casing 1 and having a receiving groove 21 receiving the shaft raw material A over both ends, an elevating means 3 such as a hydraulic cylinder or the like moving up and down the lower mold 2, an upper mold 4 arranged in an upper side of the machine casing 1 and capable of oscillating in a transverse direction with respect to a vertical line X, that is, an oscillating in the transverse direction of the receiving groove 21, and an oscillating means oscillating the upper mold 4.

The lower mold 2 is formed in a rectangular shape in a plan view, and is supported within the machine casing 1 so as to be movable up and down. The receiving groove 21 of the lower mold 2 is formed in an approximately U shape in a cross section, and is structured such as to receive about a half of the shaft raw material A in a diametrical direction. A slidable body 6 capable of sliding up and down is arranged between the lower mold 2 and the elevating means 3, the lower mold 2 is supported to the slidable body 6, and the structure is made such that the elevating means 3 slides the slidable body 6, thereby moving up and down the lower mold 2.

The upper mold 4 has a rack-teeth-forming teeth portion 41*a* formed in a rectangular shape in a bottom surface view, and is provided with a mold main body 41 in which a center of the rack-teeth-forming teeth portion 41*a* in a width direction corresponds to a center O of oscillation, and a hold body 42 connected to an upper surface of the mold main body 41 and having a curved surface 42*a* and a shaft portion 42*b* extended upward from a center portion of the curved surface 42*a* in an upper side of the mold main body 41, and a support body 7 having a curved receiving surface 71 brought into contact with the curved surface 42*a* is supported to the machine casing 1. The upper mold 4 is arranged in such a manner that the center O of oscillation is at a position above the lower mold 2, and on a vertical line X in a center of the rack teeth in a face width direction.

The rack-teeth-forming teeth portion 41 *a* is inclined at about 2 degree in an oscillating direction with respect to a horizontal line of the center O of oscillation, and is structured such as to form a rack teeth by arranging the center O of oscillation in a center portion of the rack teeth in the face width direction and at a position forming a bottom of the rack-teeth-forming teeth portion 41*a* (a position forming a tooth crest of the rack teeth in the rack shaft), and oscillating the upper mold 4 alternately at about 2 degree. Further, the rack-teeth-forming teeth portion 41*a* is formed in an approximately rectangular shape having a magnitude corresponding to an entire length of the rack teeth and the face width of the rack teeth, and is structured such as to form the rack teeth over the entire length by repeating the oscillation. In this case, the rack-teeth-forming teeth portion 41*a* is symmetrically formed with respect to the center O of oscillation as shown in FIG. 2.

The oscillating means 5 is provided with a large eccentric ring 52 rotatably supported within the machine frame 1 by a bearing 51, a small eccentric ring 54 rotatably supported to an inner side of the large eccentric ring 52 by a bearing 53 and having an inner portion to which the shaft portion 42*b* is coupled so as to be relatively rotatable, a first drive wheel 55 coupled to the large eccentric ring 52 in an interlocking manner and driven by an electric motor, and a second drive wheel 56 coupled to the small eccentric ring 54 in an interlocking manner and driven by the electric motor. The electric motor is structured such as to rotate the large eccentric ring 52 and the small eccentric ring 54 at a uniform speed and in an inverse direction to each other (for example, forward rotate the large eccentric ring 52 and backward rotate the small eccentric ring 54), thereby oscillating the upper mold 4 at about 2 degree in a transverse direction with respect to the vertical line X.

FIG. 4A to 4D are an explanatory view showing a manufacturing step in a manufacturing method of manufacturing the rack shaft. The manufacture of the rack shaft by the rocking die forging press machine is executed by the following steps.

Figure 4A:
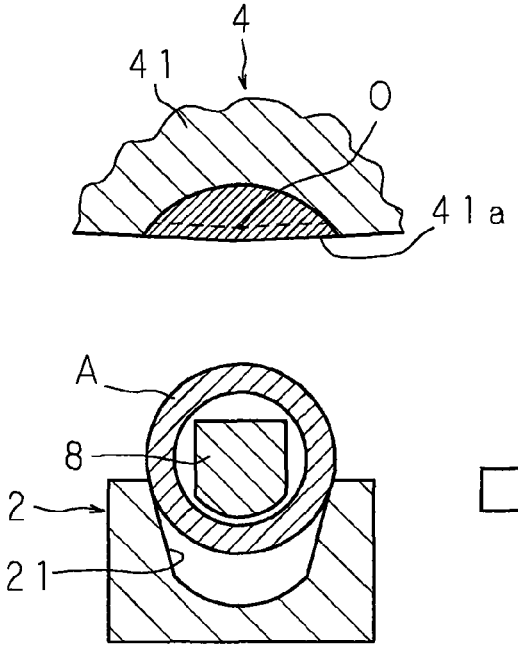
FIGS. 4A to 4D are explanatory views showing a manufacturing step of a manufacturing method of manufacturing a rack shaft.
Figure 4B:
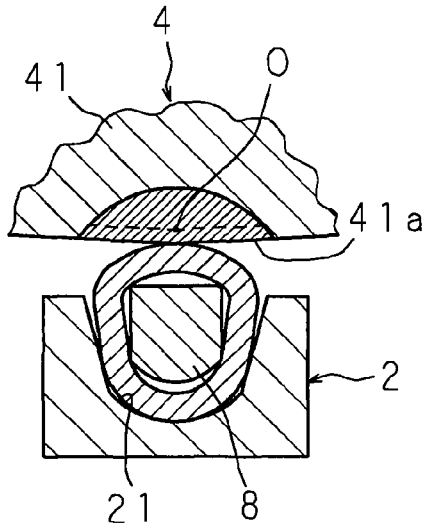

(1) The shaft raw material A constituted by the metal round pipe is mounted on the receiving groove 21 of the lower mold 2 descended by the elevating means 3 (refer to FIG. 4A).

(2) The center O of oscillation of the upper mold 4 is arranged on the vertical line X in the center of the rack teeth in the face width direction.

(3) A metal cored bar 8 formed in a rod shape is inserted to an inner side of the shaft raw material A at the position corresponding to the rack-teeth-forming teeth portion 41*a*. The cored bar 8 is structured such that an upper surface corresponding to the rack teeth and side surfaces connected to both edges of the upper surface in a width direction are formed flat, and a lower surface is curved in a protruding manner. In this case, the cored bar 8 may be inserted to the inner side of the shaft raw material A in a step before the step of mounting the shaft raw material A on the receiving groove 21.

(4) The lower mold 2 is ascended by the elevating means 3, the shaft raw material A is pressed against the rack-teeth-forming teeth portion 41*a* of the upper mold 4, the shaft raw material A is deformed along the receiving groove 21 (refer to FIG. 4B), and the displacement of the shaft raw material A in the peripheral direction is restricted by the receiving groove 21.

Figure 4C:
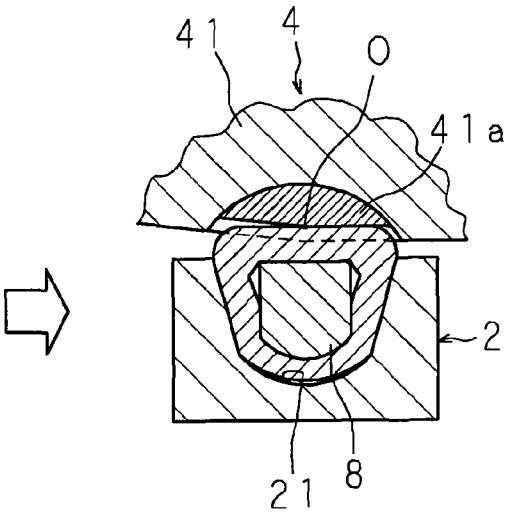
Figure 4D:
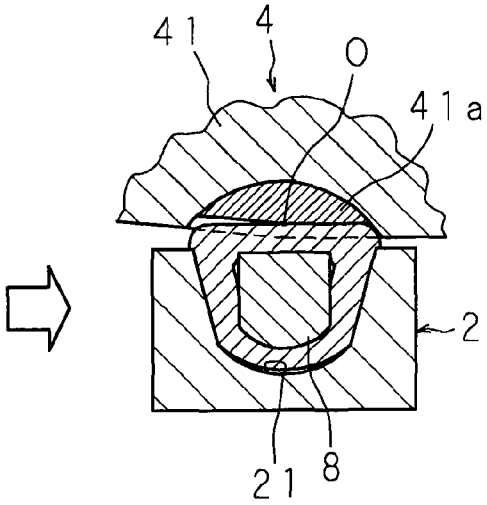

(5) The lower mold 2 is further ascended by the elevating means 3, the upper mold 4 is alternately oscillated with respect to the vertical line X by the oscillating means 5 while increasing the pressing force applied to the rack-teeth-forming teeth portion 41*a* and the shaft raw material A, and the rack teeth is formed by deforming the shaft raw material A whose the displacement in the peripheral direction is restricted by the receiving groove 21 (refer to FIGS. 4C and 4D). Since the upper mold 4 is oscillated in a state in which the displacement in the peripheral direction of the shaft raw material A is restricted by the receiving groove 21 as mentioned above, it is possible to accurately form the rack teeth. Further, the upper mold 4 is arranged at a position where the center O of oscillation corresponds to the center portion in the face width direction, thereby evenly and alternately press the positions whose distances in the diametrical direction from the center portion of the shaft raw material A in the diametrical direction are equal. Accordingly, the pressing force can be uniformly applied to the shaft raw material A in the diametrical direction, so that the generation of the underfill at the end of the rack teeth in the face width direction is suppressed. Further, even in a rack teeth of a variable ratio in which the pitch is partially different, it is possible to accurately form the rack teeth.

(6) After the end of the formation of the rack teeth, the oscillation of the upper mold 4 by the oscillating means 5 is stopped, the lower mold 2 is descended by the elevating means 3, the shaft raw material A is unloaded from the receiving groove 21 of the lower mold 2, and the cored rod 8 is taken out from the inner side of the shaft raw material A. A trace by the center O of oscillation is generated on the surface of the center in the width direction of the rack teeth in the rack shaft manufactured as mentioned above, and it is possible to judge whether or not the rack shaft is manufactured by the rocking die forging press machine, by visually recognizing the trace. In this case, the cored bar 8 may be left within the shaft raw material A without being taken out, however, can make the rack shaft light in weight by being taken out, and the cored bar 8 can be repeatedly used.

The embodiment mentioned above uses the lower mold 2 having the receiving groove 21 having the approximately U-shaped cross section. However, it is also possible to use a lower mold 2 having an approximately semicircular receiving groove 21 corresponding to the peripheral surface of the shaft raw material A.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A manufacturing method of a rack shaft comprising the steps of:

mounting a shaft raw material on a receiving groove of a lower mold;

pressing a part of a peripheral surface of the shaft raw material with an upper mold having a rack-teeth-forming teeth portion formed in a rectangular shape in a bottom view; and oscillating the upper mold with respect to the shaft raw material in a width direction of the receiving groove and around an oscillation center which lies on a center in a width direction of the rack-teeth-forming teeth portion and at a bottom of the rack-teeth-forming teeth portion, thereby forming rack teeth on said part of said peripheral surface of said shaft raw material, wherein the rack-teeth-forming teeth portion has a surface which is inclined with respect to a horizontal line through the oscillation center at substantially the same angle that the upper mold is oscillated and the rack-teeth-forming teeth portion is symmetrically formed with respect to the oscillation center.

2. The manufacturing method of a rack shaft according to claim 1, wherein one of the lower mold and the upper mold is allowed to move up and down, and a cross section of the receiving groove is formed approximately in a U shape, said pressing step further comprises pressing the shaft raw material mounted on the receiving groove by upward or downward movement of the one of the lower mold and the upper mold, and deforming the shaft raw material along the receiving groove, and said forming step further comprises forming the rack teeth by the upper mold.

3. The manufacturing method of a rack shaft according to claim 2, further comprising arranging the upper mold in such a manner that the oscillation center lies on a vertical line of the center in the width direction of the rack teeth being formed.

4. The manufacturing method of a rack shaft according to claim 1, further comprising arranging the upper mold in such a manner that the oscillation center lies on a vertical line of the center in the width direction of the rack teeth being formed.

* * * * *